US009410353B2

(12) United States Patent
Lee et al.

(10) Patent No.: US 9,410,353 B2
(45) Date of Patent: Aug. 9, 2016

(54) DOOR CLOSER

(71) Applicant: DAWON SDS CO., LTD, Seo-gu, Daegu (KR)

(72) Inventors: Joungwoo Lee, Daegu (KR); Jaebok Kang, Daegu (KR)

(73) Assignee: DAWON SDS CO., LTD, Seo-Gu, Daegu (KR)

( * ) Notice: Subject to any disclaimer, the term of this patent is extended or adjusted under 35 U.S.C. 154(b) by 0 days.

(21) Appl. No.: 14/649,043

(22) PCT Filed: Dec. 3, 2013

(86) PCT No.: PCT/KR2013/011083
§ 371 (c)(1),
(2) Date: Jun. 2, 2015

(87) PCT Pub. No.: WO2014/088280
PCT Pub. Date: Jun. 12, 2014

(65) Prior Publication Data

US 2015/0315833 A1 Nov. 5, 2015

(30) Foreign Application Priority Data

Dec. 3, 2012 (KR) ..... 10-2012-0139177

(51) Int. Cl.
*E05F 1/10* (2006.01)
*E05F 3/10* (2006.01)

(52) U.S. Cl.
CPC ..... *E05F 3/102* (2013.01); *E05F 1/1008* (2013.01); *E05Y 2800/264* (2013.01); *E05Y 2800/73* (2013.01); *Y10T 16/2766* (2015.01); *Y10T 16/293* (2015.01)

(58) Field of Classification Search
CPC . Y10T 16/577; Y10T 16/2804; Y10T 16/285; Y10T 16/293; Y10T 16/585; Y10T 16/299; Y10T 16/286; Y10T 16/27; E05F 3/10; E05F 3/12; E05F 3/104; E05F 3/102; E05F 3/22; E05F 3/221; E05F 3/223; E05F 3/227; E05Y 2900/132
See application file for complete search history.

(56) References Cited

U.S. PATENT DOCUMENTS 1,595,722 A * 8/1926 Norton ..... E05F 3/102 16/281
1,595,723 A * 8/1926 Norton ..... E05F 3/102 16/354

(Continued)

FOREIGN PATENT DOCUMENTS

JP 11-081788 A 3/1999
JP 2881552 B2 4/1999

(Continued)

OTHER PUBLICATIONS

International Search Report of International Application No. PCT /KR2013/011061 mailed Feb. 12, 2014.

(Continued)

*Primary Examiner* — Chuck Mah
(74) *Attorney, Agent, or Firm* — K&L Gates LLP

(57) ABSTRACT

Disclosed is a door closer of which the inside of a housing is made compact and thus is easily made smaller. The disclosed door closer is comprised so that movement of one end of a coil spring, which is relatively close to a link shaft, toward the link shaft inside of the housing is limited, and the other end of the coil spring, which is relatively far from the link shaft, moves toward the link shaft by being pushed by a piston base portion, thereby compressing the coil spring.

3 Claims, 3 Drawing Sheets

(56) References Cited

U.S. PATENT DOCUMENTS

| | | | | | |
|---|---|---|---|---|---|
| 2,933,755 | A * | 4/1960 | Martin | E05F 3/102 | 16/55 |
| 3,042,957 | A * | 7/1962 | Muessel | E05F 3/102 | 16/49 |
| 4,010,572 | A * | 3/1977 | Peterson | E05F 3/102 | 16/279 |
| 4,660,250 | A * | 4/1987 | Tillman | E05F 1/006 | 16/58 |
| 5,272,787 | A * | 12/1993 | Salena | E05F 3/102 | 16/56 |
| 5,553,353 | A * | 9/1996 | Lin | E05F 3/06 | 16/59 |
| 8,966,712 | B1 * | 3/2015 | Yu | E05F 3/02 | 16/66 |
| 2002/0133904 | A1 * | 9/2002 | Donovan | E05F 3/16 | 16/49 |
| 2004/0074145 | A1 * | 4/2004 | Homberg | E05F 3/102 | 49/64 |
| 2004/0205930 | A1 * | 10/2004 | Huang | E05F 3/00 | 16/64 |
| 2005/0246860 | A1 * | 11/2005 | Huang | E05F 3/102 | 16/79 |
| 2007/0022664 | A1 | 2/2007 | Mahonen et al. | | |

FOREIGN PATENT DOCUMENTS

| | | | |
|---|---|---|---|
| KR | 20-2000-0011289 | U | 6/2000 |
| KR | 10-2005-0090567 | A | 9/2005 |
| KR | 10-2010-0031008 | A | 3/2010 |
| KR | 10-2010-0100192 | A | 9/2010 |
| KR | 10-2011-0039084 | A | 4/2011 |
| KR | 10-2012-0019424 | A | 3/2012 |

OTHER PUBLICATIONS

International Search Report of International Application No. PCT /KR2013/011083 mailed Feb. 12, 2014.

* cited by examiner

DOOR CLOSER

CROSS-REFERENCE TO RELATED APPLICATION

This application is the United States National Stage of and claims priority to International Application No. PCT/KR2013/011083, which was filed Dec. 3, 2013, that claims priority to Korean Application No. 10-2012-0139177 filed Dec. 3, 2012, titled "DOOR CLOSER", both of which are incorporated herein by reference in their entirety.

TECHNICAL FIELD

The present invention relates to a door closer which automatically closes a hinged door by elastic force when the hinged door is opened.

BACKGROUND ART

A door closer is typically attached to a hinged door such as a front door, fire door, etc. of a house, apartment, officetel, etc. so as to automatically close the door by elastic force when it is opened. FIG. 1 is a cross-sectional view showing an example of a conventional door closer. Referring to FIG. 1, the conventional door closer comprises a housing 2, a pinion gear 4 which is fixed to a link shaft (also called a gear shaft) penetrating approximately the middle of the housing 2 and coaxially rotates with the link shaft, a coil spring 9 which is disposed on one side of the inside of the housing 2, and a spring pusher 6 which comprises a rack gear portion 7 engaged with the pinion gear 4 and pressurizes the coil spring 9 to accumulate elastic energy for closing a door (not shown) when the door is opened. The housing 2 is attached to the door, one end of a link (also called a connecting rod) is connected to the link shaft (not shown), and the other end of the link is connected to a door frame.

In the conventional door closer 1 shown in FIG. 1, the housing 2 has a space for accommodating the pinion gear 4 approximately in the middle thereof, a space for accommodating the coil spring 9 on one side thereof, and a space for accommodating the spring pusher 6 on the other side thereof. Therefore, the housing 2 cannot be easily configured compactly and reduced in size.

Meanwhile, a longer coil spring 9 having large elastic force is needed to close a heavy and large door such as a steel fire door. One side of the housing 2 is closer to a rotation axis (not shown) of the door than the other side of the housing 2, and thus it is difficult to provide a space for accommodating the large coil spring 9 by extending one side of the housing 2 in the positive (+) direction of the X axis. Moreover, the position of the pinion gear 4, i.e. the link shaft (not shown), is associated with the length of the link, which restricts the movement in the negative (−) direction of the X axis, and thus it is difficult to provide a space for accommodating the large coil spring 9 by extending the other side of the housing 2 in the negative (−) direction of the X axis. In other words, when a longer coil spring 9 is used to increase the door-closing force or efficiency in the conventional door closer 1, the link shaft (not shown) structurally needs to be more far away from the rotation axis of the door such that the door can be fully opened to 180° or the link needs to be configured longer, which is problematic.

DISCLOSURE

Technical Problem

An object of the invention is to provide a door closer which comprises a housing that is configured compactly and reduced in size.

Moreover, another object of the invention is to provide a door closer which can easily extend a large spring to be disposed in the housing and, at the same time, can be mounted to a door without the occurrence of an operation error such as poor opening of the door.

Furthermore, still another object of the invention is to provide a door closer which can be mounted to a door such that the door can be opened 180° without having to extend the length of a link even when a large spring is mounted to the inside of a housing to increase the elastic force.

Technical Solution

The present invention provides a door closer comprising: a housing which is fixed to a door; a link of which one end is connected to a door frame; a link shaft which is rotatably inserted into the housing and of which an upper end projecting to the outside of the housing is connected to the other end of the link; a pinion gear which coaxially rotates with the link shaft; a piston which is inserted into the housing to reciprocate in the longitudinal direction of the housing and comprises a rack gear portion which is formed on one end thereof and engaged with the pinion gear, a piston base portion which is formed on the other end thereof, and a piston body portion which connects the piston base portion and the rack gear portion; and a coil spring which is put on the piston body portion and is compressed and accumulates elastic energy when the link shaft rotates in a direction that closes the door, in which one end of the coil spring, which is relatively close to the link shaft, is restricted to move toward the link shaft in the housing and the other end of the coil spring, which is relatively far from the link shaft, is pushed by the piston base portion and moves toward the link shaft such that the coil spring is compressed.

Moreover, the present invention provides a door closer which comprises a coil spring which is put on the piston body portion and is compressed and accumulates elastic energy when the link shaft rotates in a direction that closes the door.

The link shaft and the pinion gear may be located on one side in the longitudinal direction of the housing and the coil spring and the piston base portion may be located on the other side in the longitudinal direction of the housing.

A spring hole, into which the coil spring is inserted, and a rack gear hole, through which the rack gear portion reciprocates and which has an inner diameter smaller than the inner diameter of the spring hole, may be connected to each other in a line in the housing, and the door closer may further comprise a damping oil which is filled in the spring hole and a sealing unit which prevents the damping oil from leaking to the rack gear hole.

A receiving groove, which has an inner diameter smaller than the inner diameter of the spring hole and greater than the inner diameter of the rack gear hole, may be formed at the connection between the spring hole and the rack gear hole in the housing, the sealing unit may comprise a ring-shaped sealing member which is tightly put on the outer circumferential surface of the piston body portion and a washer which has an outer diameter greater than the inner diameter of the rack gear hole, is put on the piston body portion to be located between the sealing member and the coil spring, and is pressurized toward the rack gear hole by the coil spring, and the sealing member may be pressurized toward the rack gear hole by the washer and received in the receiving groove.

Advantageous Effects

According to the door closer of the present invention, the link shaft is biased to one side of the housing, and the coil spring which provides elastic force to close the door and the piston which compresses the coil spring are located on the other side of the housing. Thus, the housing of the door closer can be easily reduced in size.

Moreover, when a large coil spring is disposed inside the housing, the other side of the housing can be extended in the longitudinal direction, and thus the extended housing can be mounted to the door without having to changing the position of the link shaft with respect to the door. Thus, the occurrence of an operation error such as poor opening of the door can be reduced.

Furthermore, even when a large spring is mounted to the inside of the housing to increase the elastic force, the door closer can be attached to the door such that the position of the link shaft is maintained a constant distance from the rotation axis of the door. Thus, the door can be opened 180° without having to extend the length of the link.

In addition, when the door closer is mounted to the door, the link shaft which is biased to one side of the housing can be located closer to the rotation axis of the door, thereby increasing the efficiency of the door closer.

DESCRIPTION OF DRAWINGS

FIGS. 3 and 4 are cross-sectional views showing the inside of a housing of the door closer in FIG. 2, in which FIG. 3 shows the state where the door is closed, and FIG. 4 shows the state where the door is opened.

MODE FOR INVENTION

Hereinafter, a door closer in accordance with an embodiment of the present invention will be described with reference to the accompanying drawings. The terminology used herein is for the purpose of properly describing preferred embodiments only and may be changed according to the intention or usage of a user or operator. Therefore, the terminology should be defined on the basis of the overall contents of this specification.

Figure 1:
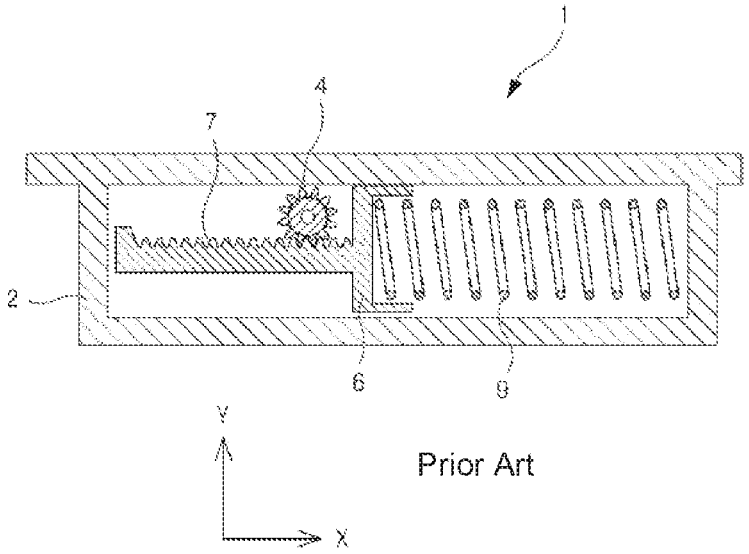
FIG. 1 is a cross-sectional view showing an example of a conventional door closer.
Figure 2:
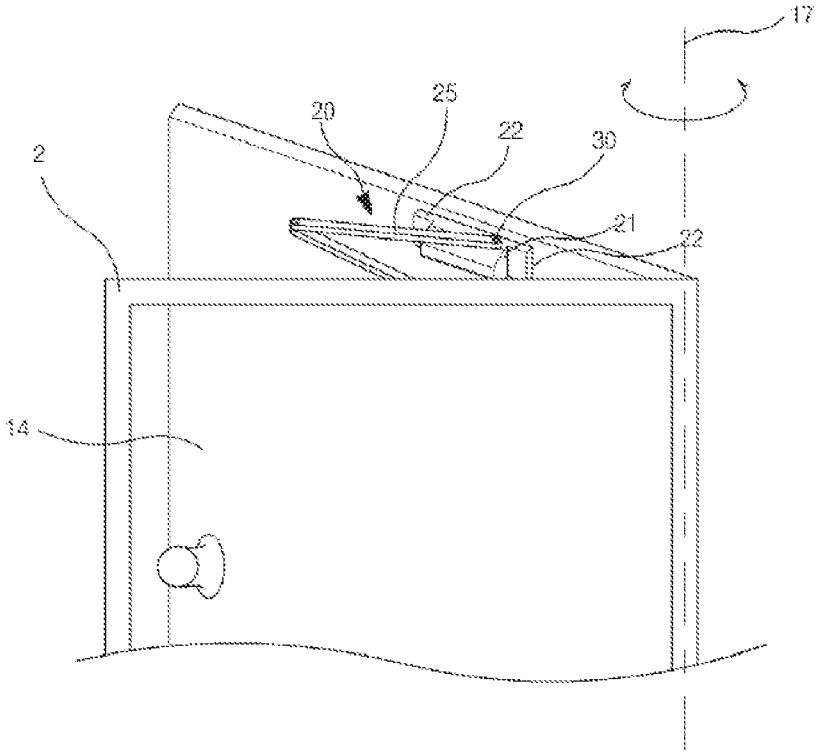
Prior Art Fig. 2
FIG. 2 is a perspective view showing a door to which a door closer in accordance with an embodiment of the present invention is mounted.

FIG. 2 is a perspective view showing a door to which a door closer in accordance with an embodiment of the present invention is mounted. Referring to FIG. 2, a door closer 20 in accordance with an embodiment of the present invention is attached to an upper surface of a hinged door 14 which is opened and closed by rotating with respect to a vertical rotation axis 17. Specifically, a pair of flanges 22 are fixedly attached to a housing 21 of the door closer 20 by means of screws. One end of a link 25, to which a pair of sticks are connected, is connected to an upper side of a door frame 2, and the other end of the link 25 is connected to an upper end of a link shaft 30 which penetrates the housing 21.

Figure 3:
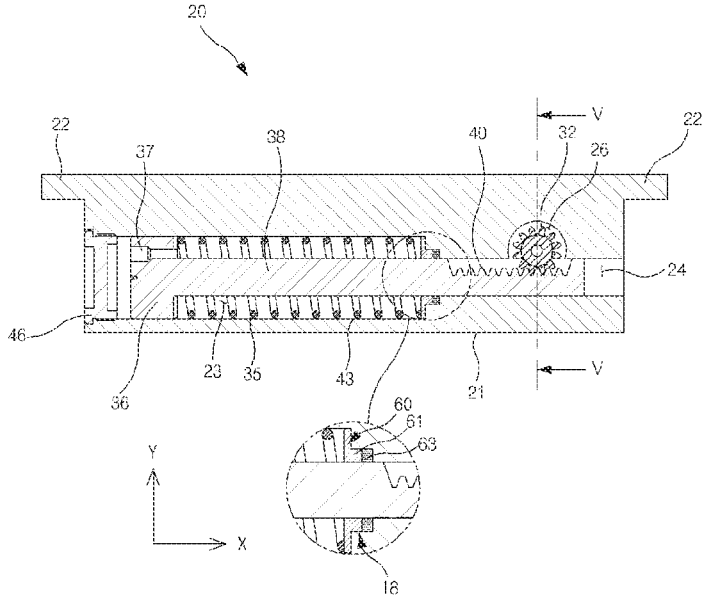
Figure 4:
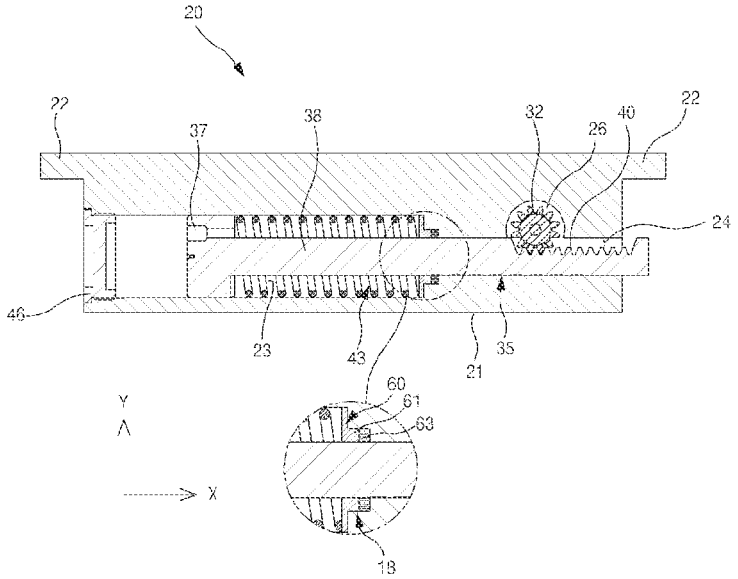
Figure 5:
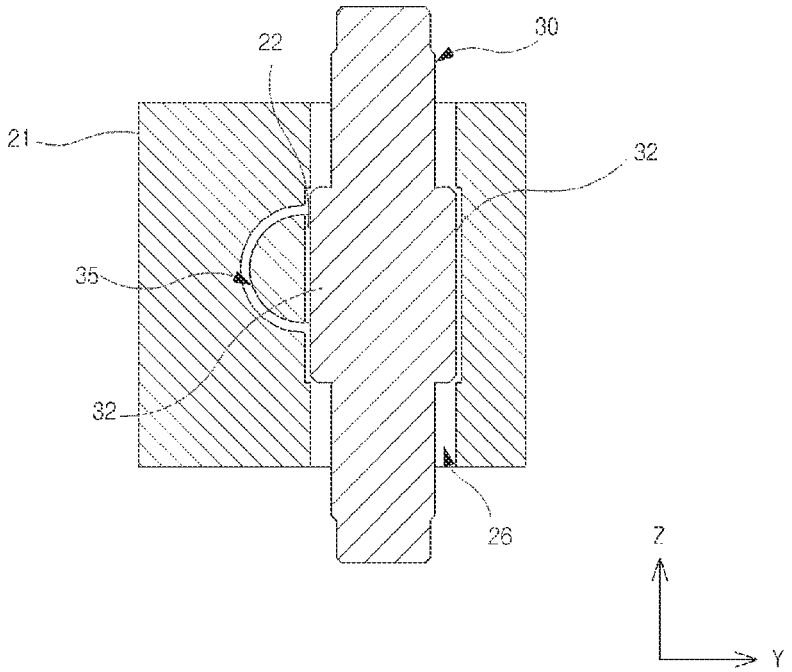
FIG. 5 is a cross-sectional view along the line V-V of FIG. 3.

FIGS. 3 and 4 are cross-sectional views showing the inside of the housing of the door closer in FIG. 2, in which FIG. 3 shows the state where the door is closed, and FIG. 4 shows the state where the door is opened. FIG. 5 is a cross-sectional view along the line V-V of FIG. 3. Referring to FIGS. 3 to 5, the door closer 20 in accordance with an embodiment of the present invention comprises a pinion gear 32, a piston 35, and a coil spring 43, which are provided in the housing 21.

The pinion gear 32 is formed on the outer circumferential surface of the link shaft 30 and coaxially rotates with the link shaft 30 with respect to the rotation axis of the link shaft 30 which is in parallel to the Z axis. The link shaft 30 is inserted and mounted into a link shaft hole 26 which formed in a direction parallel to the Z axis in the housing 21. The piston 35 extends in the longitudinal direction of the housing 21, i.e. in a direction parallel to the X axis, and is inserted into the housing 21 to reciprocate in the longitudinal direction of the housing 21. The piston 35 comprises a rack gear portion 40 which is formed on one end thereof and engaged with the pinion gear 32, a piston base portion 36 which is formed on the other end thereof, and a piston body portion 38 which connects the piston base portion 36 and the rack gear portion 40.

The coil spring 43 is a compression spring which accumulates elastic energy upon compression and is put on the piston 35, specifically, on the piston body portion 38. When the piston base portion 36 moves towards the link shaft 30, i.e., when the piston 35 in which the rack gear portion 40 is engaged with the pinion gear 32 moves in the positive (+) direction of the X axis, the coil spring 43 is compressed and accumulates elastic energy. At this time, the coil spring 43 elastically pressurizes the piston 35 such that the link shaft 30 rotates in a direction that closes the door 14 (see FIG. 2).

The link shaft 30 and the pinion gear 32 are located on one side in the longitudinal direction of the housing 21 (in FIG. 3, the right side of the housing 21), and the coil spring 43 and the piston base portion 36 are located on the other side in the longitudinal direction of the housing 21 (in FIG. 3, the left side of the housing 21). The coil spring 43 and the piston 35 can be arranged to overlap each other in the housing 21, and thus the inside of the housing 21 can be configured compactly and can be reduced in size.

In the housing 21, a spring hole 23, into which the coil spring 43 is inserted, and a rack gear hole 24, through which the rack gear portion 40 reciprocates and which has an inner diameter smaller than the inner diameter of the spring hole 23, are connected to each other in a line. The coil spring 43 is inserted into the spring hole 23, and then the piston 35 is inserted into the inside of the housing 21 through the spring hole 23. The rack gear portion 40 passes through the spring hole 23 and enters the rack gear hole 24. One end of the coil spring 43 has an inner diameter that decreases at the boundary between the spring hole 23 and the rack gear hole 24, and thus the movement of the coil spring 43 in the positive (+) direction of the X axis is restricted. When the piston base portion 36 moves in the positive (+) direction of the X axis, the other end of the coil spring 43 is pushed by the piston base portion 36 and moves in the same direction. Therefore, when the piston 35 moves in the positive (+) direction of the X axis, the coil spring 43 is compressed, and when the piston 35 moves in the negative (−) direction of the X axis, the coil spring 43 is expanded and restored.

According to the door closer 20 of the present invention, even when a large spring 43 is mounted in the housing 21 to increase the door-closing force, the door closer 20 can be attached to the door 14 such that the position of the link shaft 30 (see FIG. 5) is maintained a constant distance from the rotation axis 17 of the door. Therefore, it is possible to fully open the door 14 to 180° without having to extend the length of the link 25. Moreover, when the door closer 20 is mounted to the door 14, the link shaft 30, which is biased to one side of the housing 21, can be located closer to the rotation axis 17 of the door, thereby increasing the efficiency of the door closer 20.

The door closer 20 comprises a damping oil which is filled in the spring hole 23 and a sealing unit which prevents the damping oil from leaking to the rack gear hole 24. The sealing unit comprises a sealing member 63 and a washer 60. The sealing member 63 is typically made of rubber and has a ring shape that is tightly put on the outer circumferential surface of the piston body portion 38. A U-packing having a U-shaped cross section may be used as the sealing member 63.

The washer 60 is made of metal, has an outer diameter greater than the inner diameter of the rack gear hole 24, and is put on the piston body portion 38 to be located between the sealing member 63 and the coil spring 43. The washer 60 is located in the spring hole 23 and pressurized toward the rack gear hole 24 by the coil spring 43. In the housing 21, a receiving groove 18 having an inner diameter smaller than the inner diameter of the spring hole 23 and greater than the inner diameter of the rack gear hole 24 is formed at the connection between the spring hole 23 and the rack gear hole 24, and the sealing member 63 is pressurized toward the rack gear hole 24 by the washer 60 and received in the receiving groove 18. The washer 60 comprises an inner circumferential projection 61 which projects so as to push the sealing member 63 to the inside of the receiving groove 18. Even when the piston 35 moves in the negative (−) direction of the X axis as well as in the positive (+) direction of the X axis, the washer 60 pressurized by the coil spring 43 pressurizes the sealing member 63 toward the rack gear hole 24, and thus the sealing member 63 is not separated from the receiving groove 18, thereby preventing the leakage of the damping oil.

Specifically, the entrance of the spring hole 23 formed on the other side of the housing 21 is sealed and closed by a cap 46, and the boundary between the rack gear hole 24 and the spring hole 23 is sealed by a ring-shaped sealing member 63 made of rubber such that the only the piston body portion 38 can move.

Moreover, an oil passage hole 37 is provided in the piston base portion 36. When the piston 35 moves in the positive (+) direction of the X axis, i.e., when the door 14 (see FIG. 2) is opened, the damping oil present at the coil spring 43 in the spring hole 23 moves toward the cap 46 through the oil passage hole 37 to delay the movement speed of the piston 35, thereby reducing the impact due to sudden opening of the door 14. Meanwhile, when the piston 35 moves in the negative (−) direction of the X axis, i.e., when the door 14 is closed, the damping oil present at the cap 46 in the spring hole 23 moves toward the coil spring 43 through the oil passage hole 37 to delay the movement speed of the piston 35, thereby reducing the impact due to sudden closing of the door 14.

In the following, the door opening and closing operation by the door closer 20 will be described by sequentially referring to FIGS. 3 and 4. First, the door 14 (see FIG. 2) is closed in FIG. 3, and when the door 14 starts to be opened, the pinion gear 32 formed in the link shaft 30 (see FIG. 5) rotates in the counterclockwise direction, and as shown in FIG. 4, the piston 35 moves in the positive (+) direction of the X axis to the maximum, and the coil spring 43 is compressed to its maximum.

When the power to open the door 14 (see FIG. 2) is cancelled in the state shown in FIG. 4, the coil spring 43 expands and elastically pressurizes the piston base portion 36 in the negative (−) direction of the X axis such that the piston 35 moves in the negative (−) direction of the X axis. Accordingly, the pinion gear 32 and the link shaft 30 (see FIG. 5) rotate in the clockwise direction that the door 14 is closed. The piston 35 and the coil spring 43 are restored to the state shown in FIG. 3.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

INDUSTRIAL APPLICABILITY

The door closer of the present invention can be applied to a hinged door such as a front door, fire door, etc. of a house, apartment, officetel, etc.

The invention claimed is:

1. A door closer comprising:

a housing which is fixed to a door;

a link of which one end is connected to a door frame;

a link shaft which is rotatably inserted into the housing and of which an upper end projecting to the outside of the housing is connected to the other end of the link;

a pinion gear which coaxially rotates with the link shaft;

a piston which is inserted into the housing to reciprocate in the longitudinal direction of the housing and comprises a rack gear portion which is formed on one end thereof and engaged with the pinion gear, a piston base portion which is formed on the other end thereof, and a piston body portion which connects the piston base portion and the rack gear portion; and a coil spring which is put on the piston body portion and is compressed and accumulates elastic energy when the link shaft rotates in a direction that opens the door, wherein one end of the coil spring, which is relatively close to the link shaft, is restricted to move toward the link shaft in the housing and the other end of the coil spring, which is relatively far from the link shaft, is pushed by the piston base portion and moves toward the link shaft such that the coil spring is compressed, wherein a spring hole, into which the coil spring is inserted, and a rack gear hole, through which the rack gear portion reciprocates and which has an inner diameter smaller than the inner diameter of the spring hole, are connected to each other in a line in the housing, and wherein the door closer further comprises a damping oil which is filled in the spring hole and a sealing unit which prevents the damping oil from leaking to the rack gear hole.

2. The door closer of claim 1, wherein the link shaft and the pinion gear are located on one side in the longitudinal direction of the housing and the coil spring and the piston base portion are located on the other side in the longitudinal direction of the housing.

3. The door closer of claim 1, wherein a receiving groove, which has an inner diameter smaller than the inner diameter of the spring hole and greater than the inner diameter of the rack gear hole, is formed at the connection between the spring hole and the rack gear hole in the housing, wherein the sealing unit comprises a ring-shaped sealing member which is tightly put on the outer circumferential surface of the piston body portion and a washer which has an outer diameter greater than the inner diameter of the rack gear hole, is put on the piston body portion to be located between the sealing member and the coil spring, and is pressurized toward the rack gear hole by the coil spring, and wherein the sealing member is pressurized toward the rack gear hole by the washer and received in the receiving groove.

* * * * *